United States Patent [19]

Otani

[11] 4,139,255

[45] Feb. 13, 1979

[54] TERMINAL PIN HOLDING BLOCK

[75] Inventor: Shuichi Otani, Tokyo, Japan

[73] Assignee: Nissan Motor Company, Limited, Japan

[21] Appl. No.: 817,618

[22] Filed: Jul. 21, 1977

[30] Foreign Application Priority Data

Jul. 22, 1976 [JP] Japan ..... 51/97808[U]

[51] Int. Cl.[2] ..... H01R 9/08

[52] U.S. Cl. ..... 339/217 S; 339/10; 339/252 R

[58] Field of Search ..... 339/217 S, 217 J, 10, 339/252 R, 252 S, 253 R, 253 S

[56] References Cited

U.S. PATENT DOCUMENTS

| | | | |
|---|---|---|---|
| 3,462,726 | 8/1969 | Stark et al. | 339/217 S X |
| 3,474,398 | 10/1969 | Piorruneck | 339/217 S |

*Primary Examiner*—Howard N. Goldberg
*Assistant Examiner*—DeWalden W. Jones
*Attorney, Agent, or Firm*—Robert E. Burns; Emmanuel J. Lobato; Bruce L. Adams

[57] ABSTRACT

A terminal pin is formed at its outer surface portion with first and second lug portions which are axially extending in opposite directions, the second lug portion having at its generally middle section an outwardly projected portion. Upon insertion of the terminal pin into a through passage of the housing, the outwardly projected portion of the second lug portion is brought into engagement with an engaging section formed in the passage for projecting the first lug portion outwardly to allow the same to engage with another engaging section in the passage, so that the terminal pin is held in place in the passage.

9 Claims, 10 Drawing Figures

TERMINAL PIN HOLDING BLOCK

FIELD OF THE INVENTION

The present invention relates in general to an electric connector for providing electrical connection between electric apparatus equipped in motor vehicles, and more particularly to a new and improved electrical terminal pin-holding block.

BACKGROUND OF THE INVENTION

Various electric connectors heretofore exist, each consisting of a male pin holding block and a female pin holding block which are snugly connectable with each other. Each of the blocks generally comprises a housing and a plurality of terminal pins (male pins or female pins) fixed in the housing. For providing the aforementioned connection, the two blocks are coupled with each other for thereby inserting the male pins into the female pins snugly. However, these known blocks of the connectors suffer from various disadvantages. Frequently, the tight setting of the pins to the housing becomes difficult due to unwanted deformation of the pins during the assembling process. Furthermore, in many of the known connectors, the blocks are constructed of a plurality of elements thus necessitating additional fabrication and assembly steps resulting in high costs.

SUMMARY OF THE INVENTION

It is accordingly an object of the present invention to provide a new and improved terminal pin holding block which can eliminate the above-mentioned drawbacks encountered in the conventional blocks.

BRIEF DESCRIPTION OF THE DRAWINGS

Other objects and advantages of the present invention will become more apparent from the following detailed description when taken in conjunction with the accompanying drawings, in which.

DESCRIPTION OF THE PREFERRED EMBODIMENT

Prior to describing the construction of the new electric connector of the subject invention, a description of the construction of the terminal pin holding block of the conventional connector will be given with the aid of FIGS. 1 and 2 in order to clarify the inventive steps of the invention.

Figure 1:
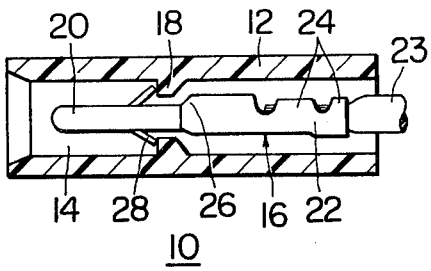
FIG. 1 PRIOR ART
FIGS. 1 and 2 are sectional views of two conventional electrical terminal pin holding blocks, these views being provided for making clear the inventive features of the present invention.

In FIG. 1, a block or a male pin holding block of the conventional electric connector is shown as being designated by a reference numeral 10. The block 10 generally comprises a housing 12 constructed of insulating material such as molded plastics. The housing 12 has at least one passage 14 therethrough which carries an electrical terminal pin or male pin 16 tightly inserted therein. The wall of the passage 14 is formed with an inward projection 18 integrally molded thereon. As shown, the male pin 16 includes a male fitting end 20 which can be snugly inserted into a female pin equipped in a female pin holding block (not shown) upon connection of these two blocks, and a wire connecting end 22 connected to an electrically conducting wire 23 by pressed sleeves 24. The male pin 16 further includes a shoulder portion 26 at the generally middle portion thereof and a pair of resilient barbs 28 which are raised up from the male fitting end 20 as shown. In assembling the male pin holding block 10, the male pin 16 is inserted into the passage 14 and then locked in place in the passage 14 by allowing the resilient barbs 28 and the shoulder portion 26 thereof to hold the inward projection 18 therebetween.

Figure 2:
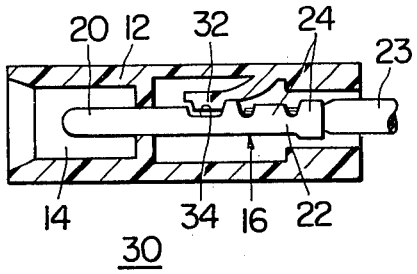
FIG. 2 PRIOR ART

In FIG. 2 another prior art male pin holding block is shown as generally designated by a numeral 30. The block 30 comprises generally same parts as in the case of the block 10 except for some parts, so that the same parts are designed by the same numerals as in FIG. 1. In case of FIG. 2, the wall of the passage 14 is integrally formed with a resilient leg latch portion 32. The free end of the leg latch portion 32 is received in a recess 34 formed in the male pin 16 for locking the same in place in the passage 14.

However, several drawbacks are inevitably encountered in the afore-mentioned two blocks 10 and 30 as follows.

In case of the conventional block 10 of FIG. 1, it occurs frequently that, during assembling work of the block, the radially outwardly projecting resilient barbs 28 contact or entangle with adjacent elements such as the barbs of the other male pins and/or the conducting wires, inducing troublesome assembly steps of block. Furthermore, in the worst case, the barbs 28 may be deformed largely due to undergoing such entanglement. This causes the male pin 26 not to firmly and rigidly be held in the housing 12 thus resulting in accidental disengagement of the male pin 26 from the block 10.

Furthermore, in case of the block 30 shown in FIG. 2, the construction of the housing 12 is very complicated because of provision of the latch portion 32 although the drawbacks encountered in the before-mentioned block 10 of FIG. 1 are eliminated. Thus, it is necessary to employ or use advanced but costly technic for molding the housing 12. Furthermore, the latching engagement between the leg latch portion 32 and the male pin 16 may not be reliably made because the latch portion 32 is constructed of plastics.

Accordingly, as stated before, the present invention contemplates to solve the above-mentioned several drawbacks encountered in the conventional blocks 10 and 30.

Figure 3:
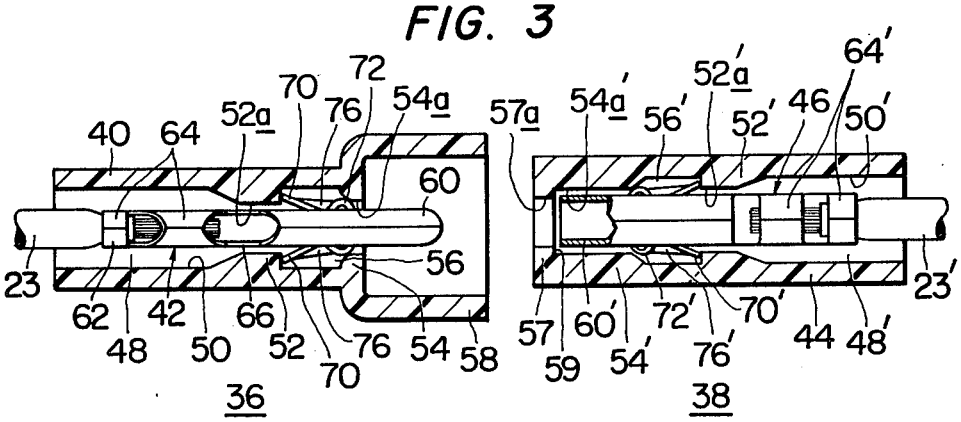
FIG. 3 is a detached sectional view of an electric connector according to the present invention, the connector being shown as including a male pin holding block (left) and a female pin holding block (right)
Figure 4:
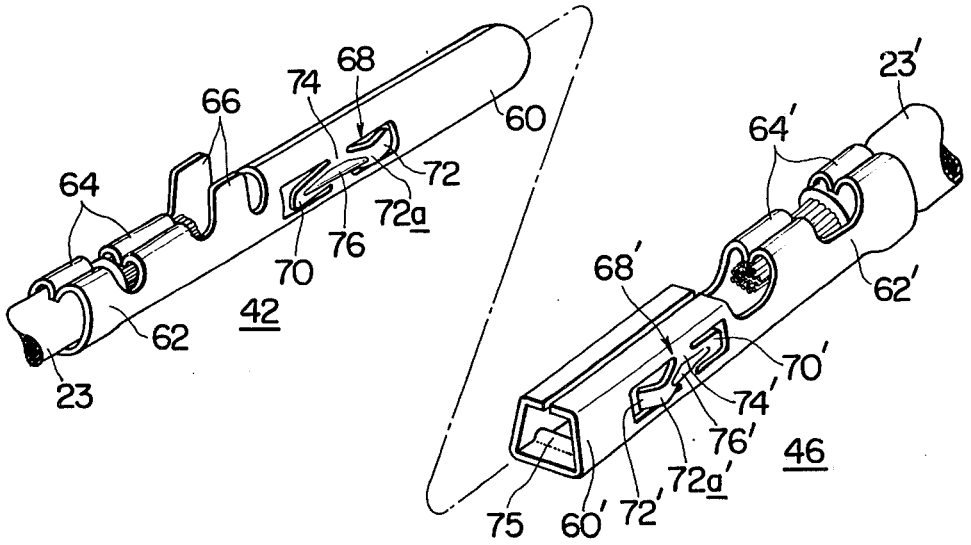
FIG. 4 is a perspective view of the electric connector shown in FIG. 3.

Referring to FIGS. 3 and 4 of the drawings, there is illustrated a new and improved electric connector as including a male pin holding block 36 (left) and a female pin holding block 38 (right). The block 36 generally comprises a housing 40 and at least one generally tubular male pin 42 held in the housing 40. The block 38 generally comprises a housing 44 and at least one female pin 46. Each of the housings 40 and 44 is preferably of one piece construction and constructed of molded plastics and has at least one passage therethrough which carries the afore-mentioned male or female pin 42 or 46 firmly inserted therein.

The male pin holding housing 40 includes at least one elongate passage 48 which is bounded by a wall 50. As shown in the drawings, the wall 50 is formed with first and second inwardly raised portions 52 and 54 which are separated from each other to define therebetween an enlarged space 56. It should be noted that an opening 54*a* bounded by the second raised portion 54 is constructed considerably smaller than an opening 52*a* bounded by the first raised portion 52 by the reasons which will be described hereinlater.

At one end of the housing 40, a housing enlarged extension 58 is integrally attached to the housing proper 40 for protecting the end of the male pin 42 inserted therein and for connecting the housing 40 to the female pin holding block 38 which will be described later.

As well shown in FIG. 4, the male pin 42 includes a male fitting end 60 which is snugly inserted into the female pin 46 equipped in the female pin holding block 38 upon connection of these two blocks 36 and 38, and a wire connecting end 62 connected to a wire 23 by pressed sleeves 64 or other suitable means. The male pin 42 further includes two integral projections 66 which are shown parallelly and upwardly extending from the corresponding cylindrical side wall portions of the pin 42. The purpose of the projections 66 is to prevent the male pin 42 from rotating about its axis during the insertion of the pin 42 into the passage 48 of the housing 40 as will be well explained later. Thus, the projections 66 act as so-called stabilizers. The male pin 42 also has two integral latching means 68 which are respectively formed in the cylindrical side portions between the male fitting end 60 and the projections 66. In FIG. 4, one of the means 68 is shown. Since, both of the means 68 are substantially identical to each other, only the construction of the shown means 68 will be hereinlater described. The latching means 68 includes first and second resilient lug portions 70 and 72 which extend from a common limited portion 74 in opposite directions in parallel with the axis of the male pin 42. These lug portions 70 and 72 are formed by cutting and rising up corresponding sections of the cylindrical side portions of the pin 42. As shown, the second lug portion 72 is bent at its generally middle section to form a radially outwardly raised portion 72*a*. For reasons which will be apparent hereinlater, the first lug portion 70 is not projected radially outwardly from the pin 42 and the raised portions 72*a* are formed or projected to allow a width defined by the two raised portions 72*a* to be slightly smaller than that by the opening 52*a* but considerably larger than that by the opening 54*a* of the housing 40. Preferably, an elongate emboss 76 is formed to extend from a generally middle section of the first lug portion 70 to the raised portion 72*a* of the second lug portion 72. With this, it will be appreciated that the first lug portion 70, more specifically its free end is caused to rise or project outwardly from the corresponding opening when the raised portion 72*a* is pushed or bent towards the inside of the pin 42. The first and second lug portions 70 and 72 thus constitute a so-called seesaw member.

The female pin holding housing 44, similar to the previously described male pin holding housing 40, is also provided with at least one elongate passage 48' bounded by a wall 50'. The wall 50' includes first and second inwardly raised portions 52' and 54' which are separated from each other to form an enlarged space 56' therebetween. Also in this case, an opening 54*a*' bounded by the second raised portion 54' is smaller than an opening 52*a*' bounded by the first raised portion 52.

The housing 44 also has a third inwardly raised portion 57 on the wall 50' at the leftmost position of the housing 44 to define an opening 57*a*. The opening 57*a* is considerably smaller than the opening 54*a*' of the second raised portion 54' to form between the openings 54*a*' and 57*a* a step 59 the purpose of which will be apparent hereinlater.

Inserted in the passage 48' of the housing 44 is a female pin 46 which has a female fitting end 60' for receiving therein the before-mentioned male fitting end 60 of the male pin 42, and a wire connecting end 62' for connecting a wire 23' by pressed sleeves 64'. As shown, the female fitting end 60' is formed to have a trapezoidal cross section and provided therein with an inward projection 75 which allows secure connection between the female and male fitting ends 60' and 60. The female pin 46 also has a pair of latching means 68' which are respectively and integrally formed on flat side portions of the female fitting end 60'. Only one latching means 68' is seen in the drawing. The means 68' also includes first and second resilient lug portions 70' and 72' which integrally extend from a common limited portion 74', the middle portion of the second lug portion 72' being bent to form an outwardly raised portion 72*a*'. An emboss 76' is also included in the means 68' in a same manner as described hereinbefore with respect to the means 68 of the male pin 42.

Figure 5A:
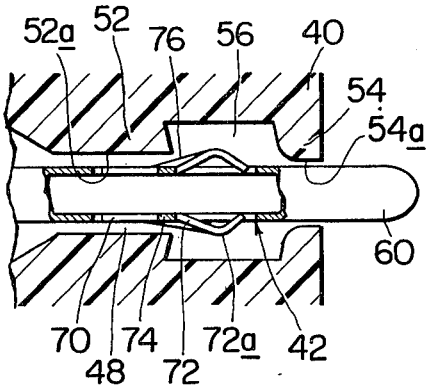
FIGS. 5A and 5B are sectional partial views of the male pin holding block showing assembly steps of the block.
Figure 5B:
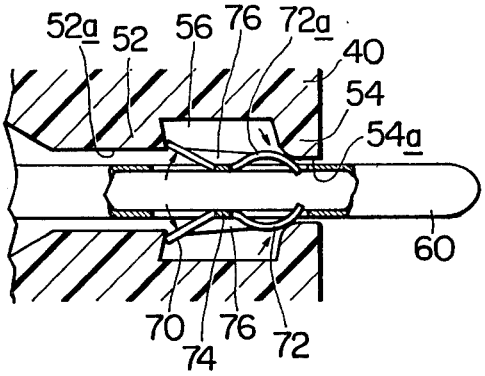

With the aid of FIGS. 5A and 5B, an explanation of assembling the terminal pin holding block will be given. Since both blocks 36 and 38 are substantially identical in assembling process, only the process for the block 36 will be described hereafter. The male fitting end 60 of the male pin 42 is inserted from the left open side of the housing 40 into the passage 48 and is moved axially to the right as viewed in FIG. 5A. This movement is smoothly made since no parts of the male pin 42 brakingly engage with the wall 50 of the passage 48 even at the opening 52*a* defined by the first raised portion 52. This is because, as mentioned before, the width defined by the two raised portions 72*a* is smaller than that of the opening 52*a*. However, when the raised portions 72*a* of the second lug portions 72 are brought into contact or engagement with the second raised portion 54 after passing through the enlarged space 56, the raised portions 72*a* are forced to be depressed inwardly of the pin 42 allowing the free ends of the first lug portions 70 to rise or project outwardly by seesaw action. As the raised portions 72*a* continue to be moved to the right to be disposed into the opening 54*a* of the housing 40, the free ends of the first lug portions 70 are finally open to such a degree as to allow the free ends thereof to project into the enlarged space 56 overpassing the opening 52*a* as viewed in FIG. 5B. Thus, the free ends of the first lug portions 70 are brought into engagement with shoulders of the first raised portion of the housing 40 and the male pin 42 is now held in place. Further axial movement of the male pin 42 to the right is prevented by selecting suitable forms of the raised portions 72*a*. Although not well shown in these drawings, it is preferable to provide the wall 50 of the passage 48 with a guide portion which is engageable with the before-mentioned stabilizing projections 66 formed on the pin 42 upon assembling of the pin 42 with the housing 40 for preventing the pin 42 from rotating about its axis in the housing 40. In case of the female pin holding block 38, the female fitting end 60' is brought into engagement with the afore-mentioned step 59 of the housing 44 so that further axial movement of the female pin 46 to the left of the drawing is prevented. Of course, the rightward movement of the female pin 46 is also prevented by the latching means 68'. Thus, the female pin 46 is tightly held in place in the housing 44.

The male and female pin holding blocks 36 and 38 are coupled together. To couple the blocks together, one end of the housing 44 is snugly inserted into the enlarged extension 58 of the housing 40. This insertion will cause the male fitting end 60 of the male pin 42 to snugly enter the female fitting end 60' of the female pin 46, thus accomplishing a continuous electrical connection between the pins 42 and 46.

Figure 6:
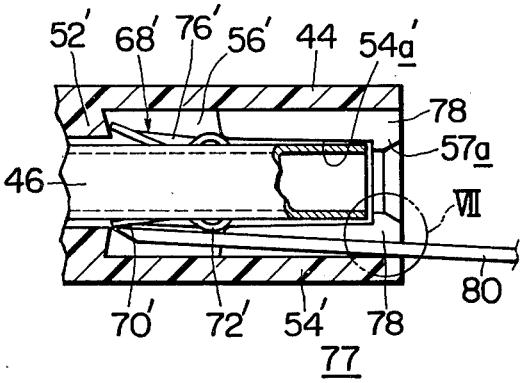
FIG. 6 is a partial sectional view of a slightly modified form of the female pin holding block shown in FIG. 3.
Figure 7:
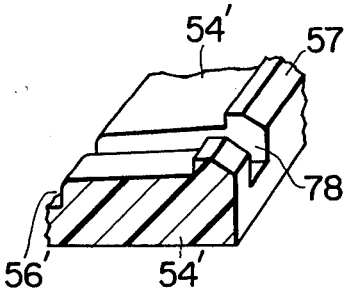
FIG. 7 is an enlarged perspective view of a part enclosed by a circle shown in FIG. 6.

A slightly modified form of the female pin holding block is shown in FIGS. 6 and 7 as generally designated by a numeral 77, in which a portion enclosed by a circle in FIG. 6 is enlarged in perspective manner in FIG. 7. In this modified case, two elongate grooves 78 are formed in the wall 50' extending across the second and third raised portions 54' and 57 to be substantially parallel with the axis of the passage 48'. With this construction, a previously installed female pin 46 is readily removed from the housing 44 only by using a small elongate tool 80 such as a small screwdriver. When it is required to remove the previously set female pin 46, the tool 80 may be inserted through the groove 78 and brought to bear in upward or downward direction of the drawing on the previously projected second lug portion 70' to depress the same toward the inside of the pin 46. Thus, the female pin 46 may be axially smoothly withdrawn from the passage 48' of the housing 44. Above-mentioned removing technic is also available in the male pin holding block 36 as long as it is provided with such kind of grooves in its wall 50.

Although in the previous description, it has been explained that the male pin or female pin has two latching means 68 or 68', it is also possible to use only one latching means 68 or 68' so long as the means provides adequate latching action.

Figure 8:
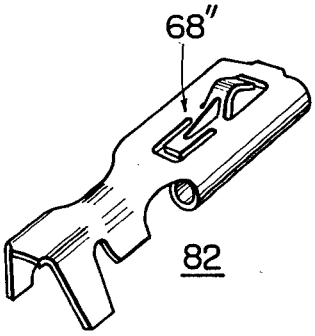
FIGS. 8 and 9 are respective modified forms of the female pin employable in the electric connector according to the present invention.
Figure 9:
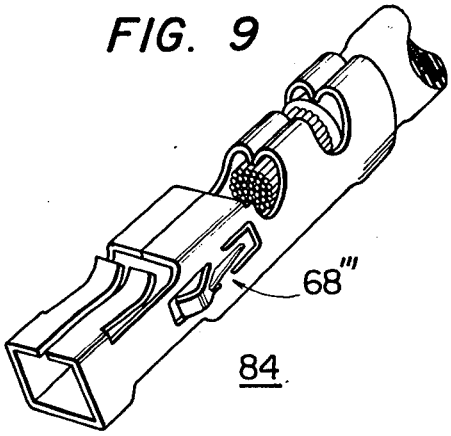

In FIGS. 8 and 9, two modified forms 82 and 84 of the female pin are illustrated, in which the pin designated by the numeral 82 is formed at its upper flat wall with only one latching means 68'' and on the contrary the pin 84 is formed at the lateral side walls with respective latching means 68'''.

Now, it should be noted that each of the housings may, if desired, have two or several pins and passages although in the previous description only one pin and passage are disclosed. Further, the male pin and female pin may take any other suitable shape in addition to the described shapes.

From the above, it will be appreciated that according to the present invention, not only simple construction of the housing inducing reduction of the manufacturing cost is achieved but also the undesirable barb to barb entanglement, which has been frequently encountered in the conventional pins, is prevented. Furthermore, by the present invention, the insertion of the pin in the corresponding housing is facilitated and the pin is firmly engaged and held in place in the housing thereby reducing the possibility of failure of the pin holding block during its use.

What is claimed is:

1. A terminal pin holding block for providing an electrical connection between apparatus when coupled with another terminal pin holding block, comprising:

a housing having a through passage bounded by a wall, said wall including first and second engaging sections longitudinally spaced from each other to define therebetween an enlarged portion of said through passage; and a terminal pin received in said through passage, said terminal pin having first and second lug portions which extend from a common limited portion of said terminal pin in opposite directions in parallel with the longitudinal axis of said terminal pin, said second lug portion projecting outwardly radially so that when said second lug portion is pressed to bend inwardly, said first lug portion projects radially outwardly, the assemblage of said terminal with said housing being such that upon final fitting of said terminal pin to said housing, said second lug portion is tightly disposed in said second engaging section to be pressed inwardly causing said first lug portion to project radially outwardly to be received in said enlarged portion of said through passage thereby preventing said terminal pin from longitudinal movement toward said first engaging section.

2. A terminal pin holding block as claimed in claim 1, in which said first and second engaging sections define radially inwardly raised portions of said wall.

3. A terminal pin holding block as claimed in claim 1, in which the opening defined by said second engaging section is smaller than that defined by said first engaging section.

4. A terminal pin holding block as claimed in claim 1, in which said second lug portion is bent at the generally middle portion thereof to define a radially outwardly raised portion engageable with said second engaging section upon the fitting of said terminal pin to said housing.

5. A terminal pin holding block as claimed in claim 1, an emboss is formed to extend from said first lug portion to said second lug porton.

6. A terminal pin holding block as claimed in claim 1, further comprising stabilizing means for preventing the pin from being rotated about the axis thereof in said through passage of said housing.

7. A terminal pin holding block as claimed in claim 6, in which said stabilizing means comprises two parallel projections which integrally extend from said terminal pin; and a guide portion formed in said wall, said projections being engageably held by said guide portion upon insertion of said terminal pin into said through passage of said housing.

8. A terminal pin holding block as claimed in claim 1, in which said housing comprises along said through passage at least one groove merged with said passage so that a tool is insertable through said groove and brought to bear on the previously projected second lug portion to depress the same toward the inside of said terminal pin, whereby the terminal pin is readily removed from said housing.

9. A terminal pin holding block for providing an electrical connection between apparatus when coupled with another pin holding block, comprising:

a housing having a through passage bounded by a wall, said wall including first and second engaging sections longitudinally spaced from each other to define therebetween an enlarged portion of said through passage;

a terminal pin received in said through passage, said terminal pin having first and second lug portions extending from a common limited portion of said terminal pin in opposite directions in parallel with the longitudinal axis of said terminal pin, said second lug portion projecting radially outwardly so that when said second lug portion is pressed to bend inwardly, said first lug portion projects radially outwardly, the assemblage of said terminal pin with said housing being such that upon final fitting of said terminal pin to said housing, said second lug portion is tightly disposed in said second engaging section to be pressed inwardly causing said first lug portion to project radially outwardly to be received in said enlarged portion of said through passage thereby preventing said terminal pin from longitudinal movement toward said first engaging section; and stabilizing means for preventing the terminal pin from being rotated about the axis thereof in said through passage of said housing, said stabilizing means comprising two parallel projections integrally extending from said terminal pin, and a guide portion in said wall, said projections being engageably held by said guide portion upon insertion of said terminal pin into said through passage of said housing.

* * * * *